United States Patent [19]

Smith et al.

[11] Patent Number: 4,919,632

[45] Date of Patent: Apr. 24, 1990

[54] COLLAPSIBLE ONE-MAN PONTOON FISHING RAFT

[76] Inventors: Richard L. Smith, 1800 Bancroft, Missoula, Mont. 59801; Frederick Wallner, 40 Scovel La., Kalispell, Mont. 59901; Alvern C. Weed, 412 Boston Ct., Davenport, Iowa 52806

[21] Appl. No.: 297,932

[22] Filed: Jan. 17, 1989

[51] Int. Cl.[5] ..... B63B 7/04

[52] U.S. Cl. ..... 441/44; 114/61; 114/352

[58] Field of Search ..... 114/61, 77 R, 352, 354, 114/363; 441/44, 45

[56] References Cited

U.S. PATENT DOCUMENTS

| | | | |
|---|---|---|---|
| 2,745,118 | 5/1956 | Potts et al. | 114/61 X |
| 3,883,909 | 5/1975 | Fisher et al. | 114/61 X |
| 4,303,033 | 12/1981 | King | 114/352 X |

FOREIGN PATENT DOCUMENTS

| | | | |
|---|---|---|---|
| 1000607 | 8/1965 | United Kingdom | 114/61 |

*Primary Examiner*—Sherman D. Basinger

[57] ABSTRACT

A collapsible fishing raft comprising pontoons, a means of connecting the said pontoons and a seat, which components are capable of being transported by one person by backpack or pack frame over high mountain foot trails.

6 Claims, 4 Drawing Sheets

COLLAPSIBLE ONE-MAN PONTOON FISHING RAFT

BACKGROUND OF THE INVENTION

The ability to fish high mountain lakes is greatly impaired by the presence of brush and cliffs. Furthermore, when access to the lake is only possible by use of a foot trail it is impossible or extremely difficult to transport a boat into such a lake. Previously the problem was addressed by backpacking inflatable rubber rafts or inner tubes equipped with a seat into the high mountain lakes. However, those devices are heavy, require a pump for inflation and can not be easily maneuvered in the water.

SUMMARY OF THE PRESENT INVENTION

In accordance with the present invention a collapsible pontoon raft fabricated from expanded polystyrene, styrofaom or similar material, provides an alternative which is lighter in weight and more maneuverable than inflatable devices. It is capable of being quickly assembled and disassembled and, in its disassembled form, can be stowed in a compartmented nylon bag which can be easily attached to any backpack or pack frame. With the operator facing to the aft, he or she can maneuver the raft using swimfins, leaving the hands free for fishing.

DETAILED DESCRIPTION OF ILLUSTRATIVE EMBODIMENT

Figure 1:
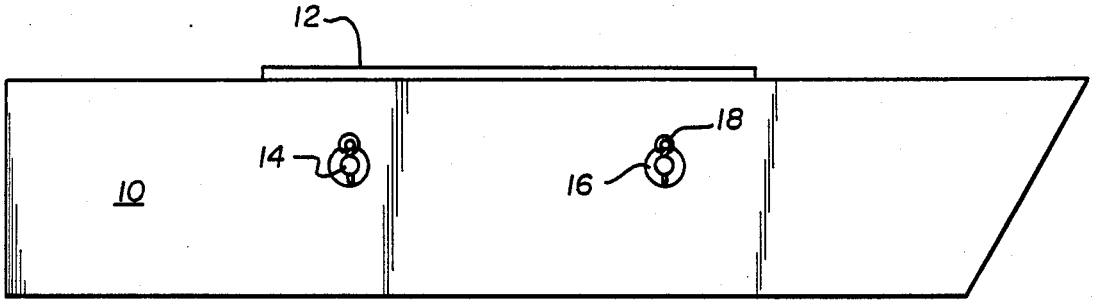
FIG. 1 is a side view of the one-piece pontoon version.

Reference is now made to FIG. 1 wherein is shown the side view of the one-piece pontoon 10 with seat 12. The pontoons are connected by connecting rods 14 secured by a washer 16 and a locking pin or cotter pin 18. The pontoons may be fabricated or molded from expanded polystyrene, styrofoam or other similar material and may be coated with Plastisol TM, Liquid Carpet TM or other protective or stabilizing substance. The seat 12 may be of one-piece plywood or plastic construction or two-piece molded plastic construction as later shown in FIG. 6 and FIG. 7.

Figure 2:
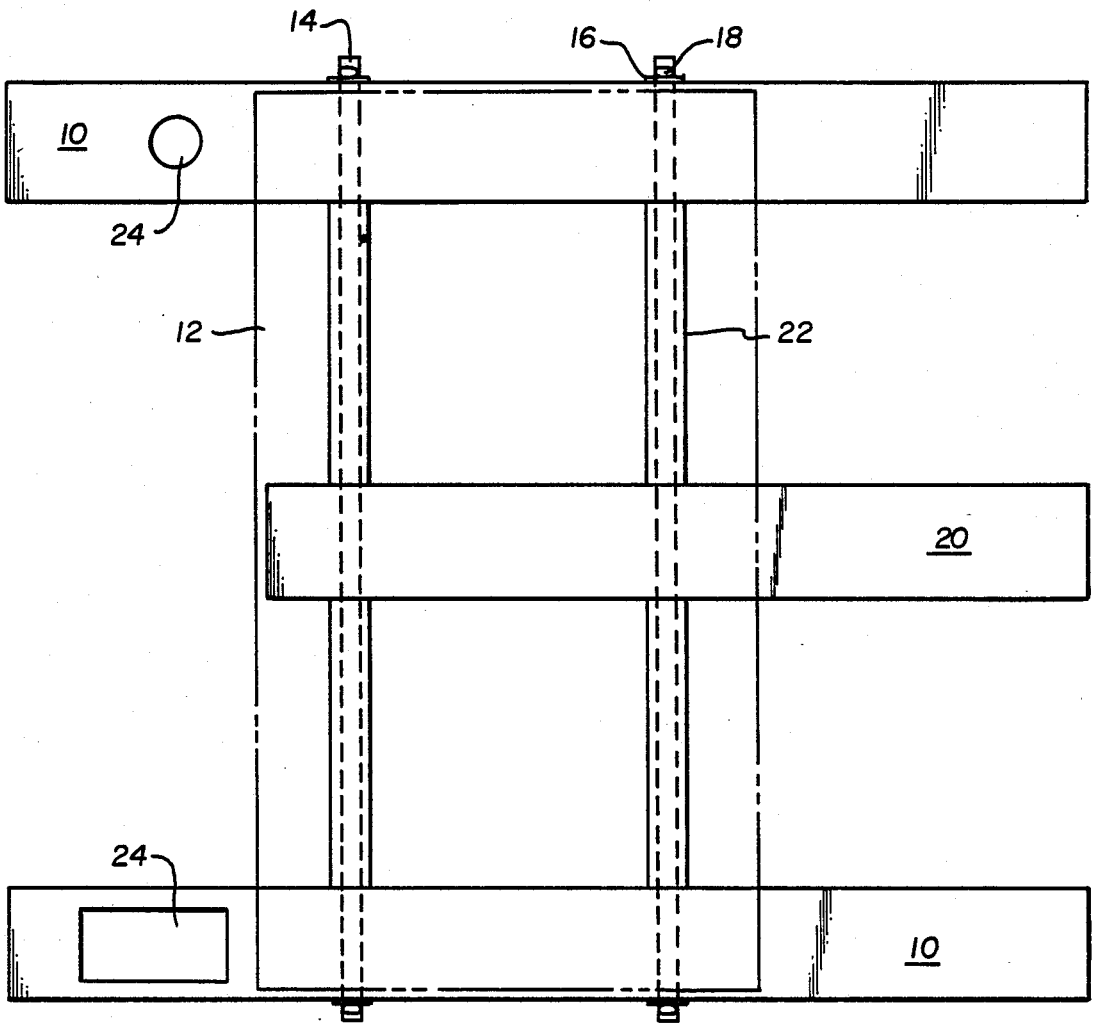
FIG. 2 is a plan view of the one-piece pontoon version.

As shown in FIG. 2 the connecting rods 14 pass through the pontoons 10 perpendicular to their length and through spacer sleeves 22 between the pontoons to prevent the pontoons from closing. The middle pontoon 20 to provide additional buoyancy for heavier persons is optional. Cut-out compartments 24 may be provided for beverage cans or fishing gear.

Figure 3:
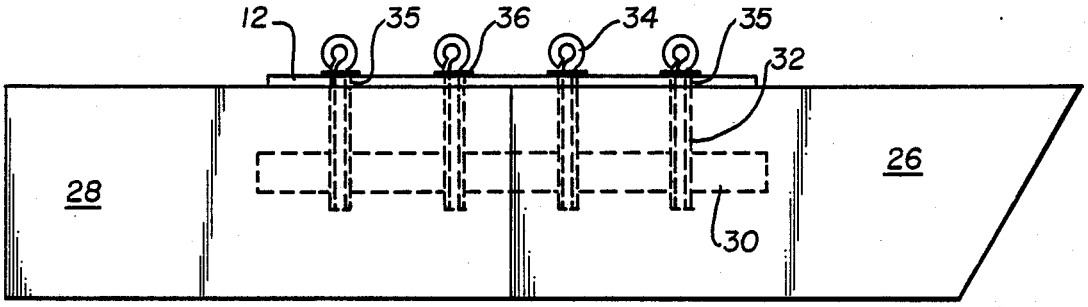
FIG. 3 is a side view of the two-piece pontoon version.

FIG. 3 shows the side view of the optional two-piece pontoon consisting of a forward section 26 and an aft section 28 which are joined by a connecting pipe 30 made from polyvinylchloride or other material. At least one sleeve 32 of similar material runs from the top of the forward pontoon section 26 and the aft pontoon section 28 and through the connecting pipe 30. The sleeve 32 accepts a securing pin 34 which passes through holes 35 and thus secures the seat 12 to the pontoon sections, 26 and 28 and maintains the structural integrity of the raft. The connecting pipe 30 may be cemented into one end of the pontoon to facilitate quick assembly. The securing pin 34 may have an optional eye which may be used to secure gear and may be tapered to better engage the sleeve 32. A washer 36 may be used to protect the seat 12 from undue wear. The center pontoon 20 is optional and must be notched to fit with the two-piece seat as shown in FIG. 6 and FIG. 7.

Figure 4:
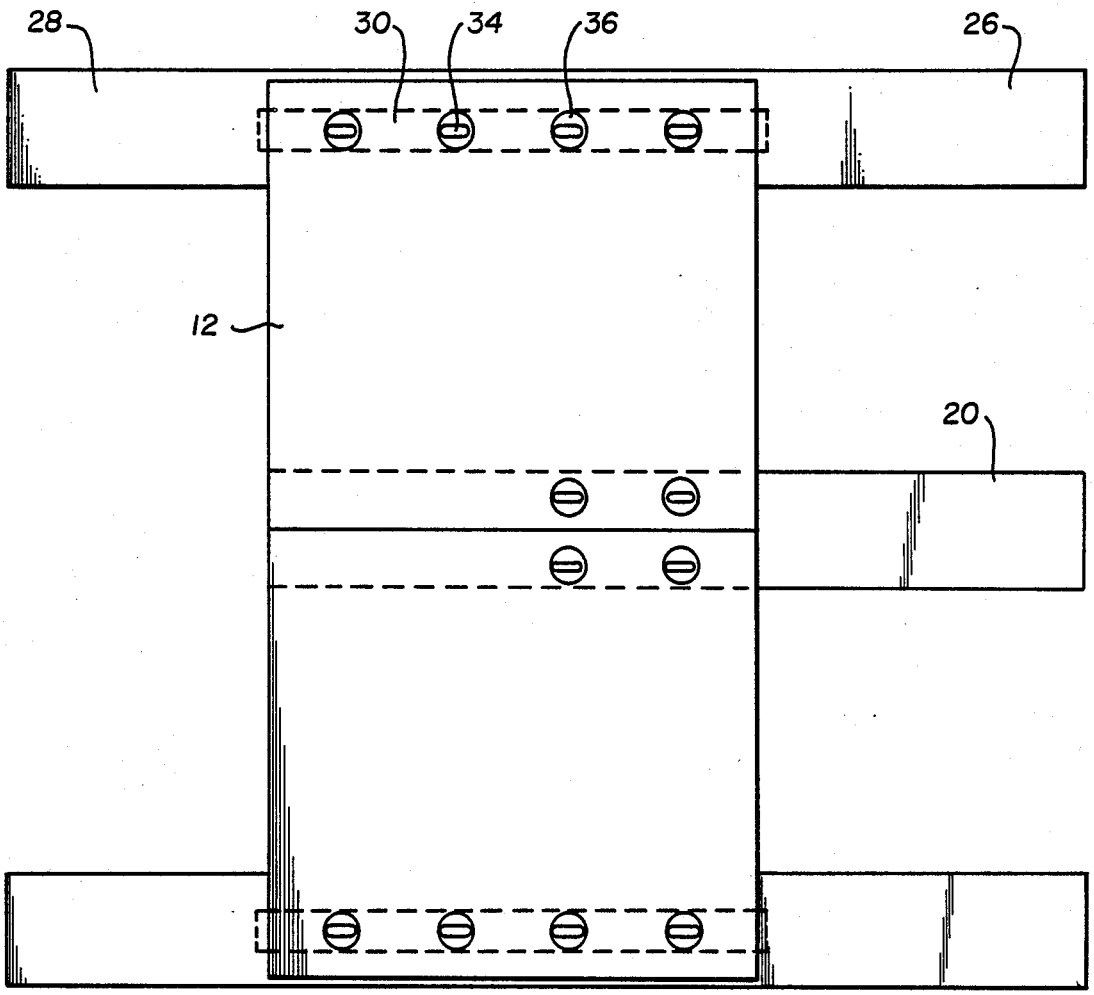
FIG. 4 is a plan view of the two-piece pontoon version.

FIG. 4 shows the plan view of the two-piece pontoon construction with each pontoon consisting of a forward section 26, an aft section 28, a seat 12 fastened by securing pins 34 which pass through holes 35 and into sleeves 32. A third pontoon 20 to provide additional buoyancy for heavier persons, is optional.

Figure 5:
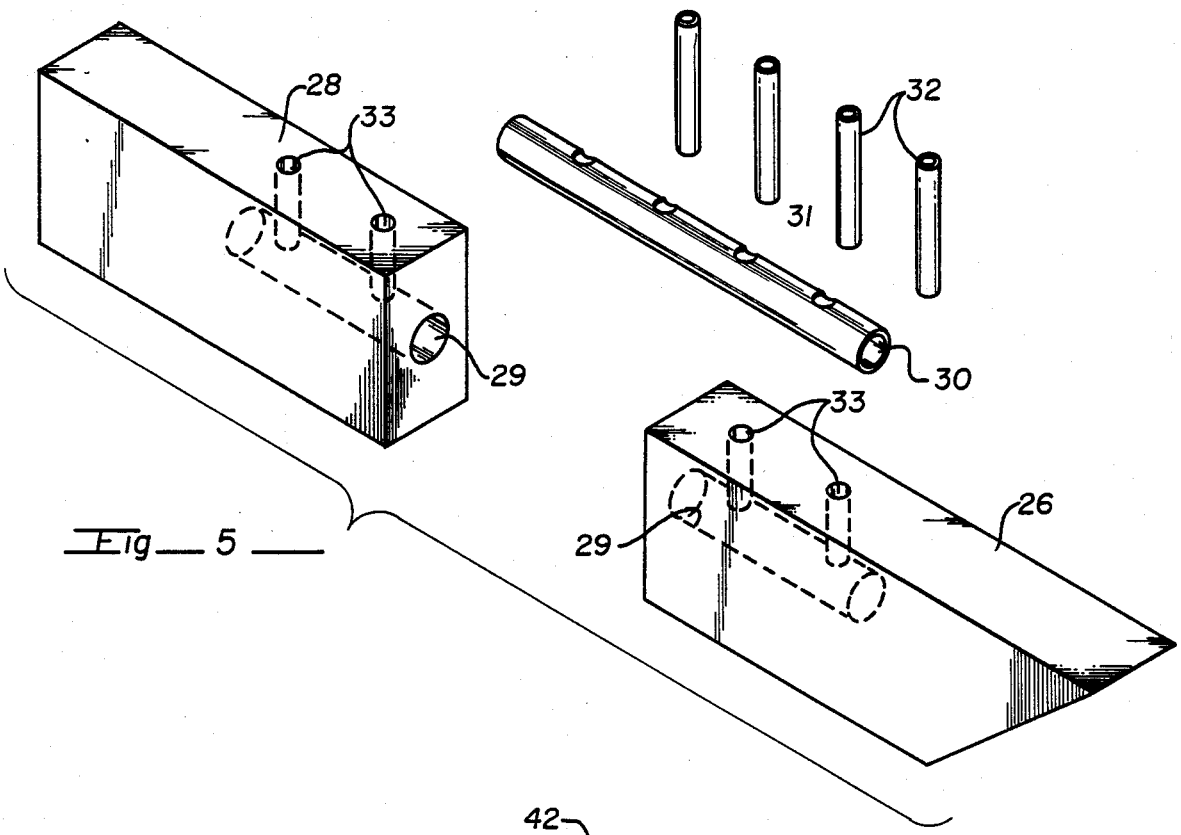
FIG. 5 is exploded view of a two-piece pontoon.
Figure 8:
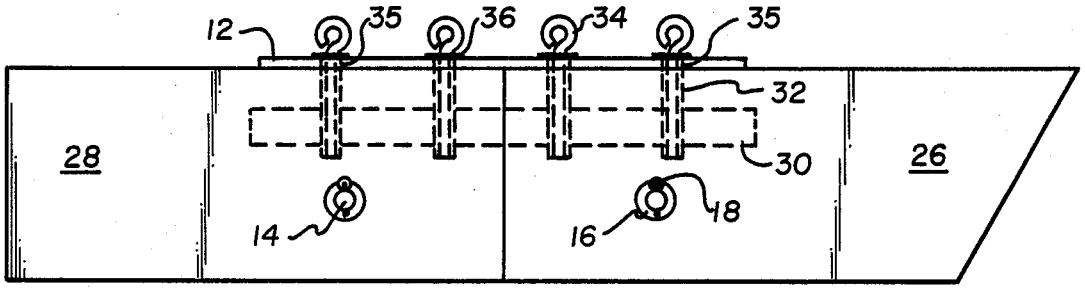
FIG. 8 is a side view of the two-piece pontoon with connecting rods.
Figure 9:
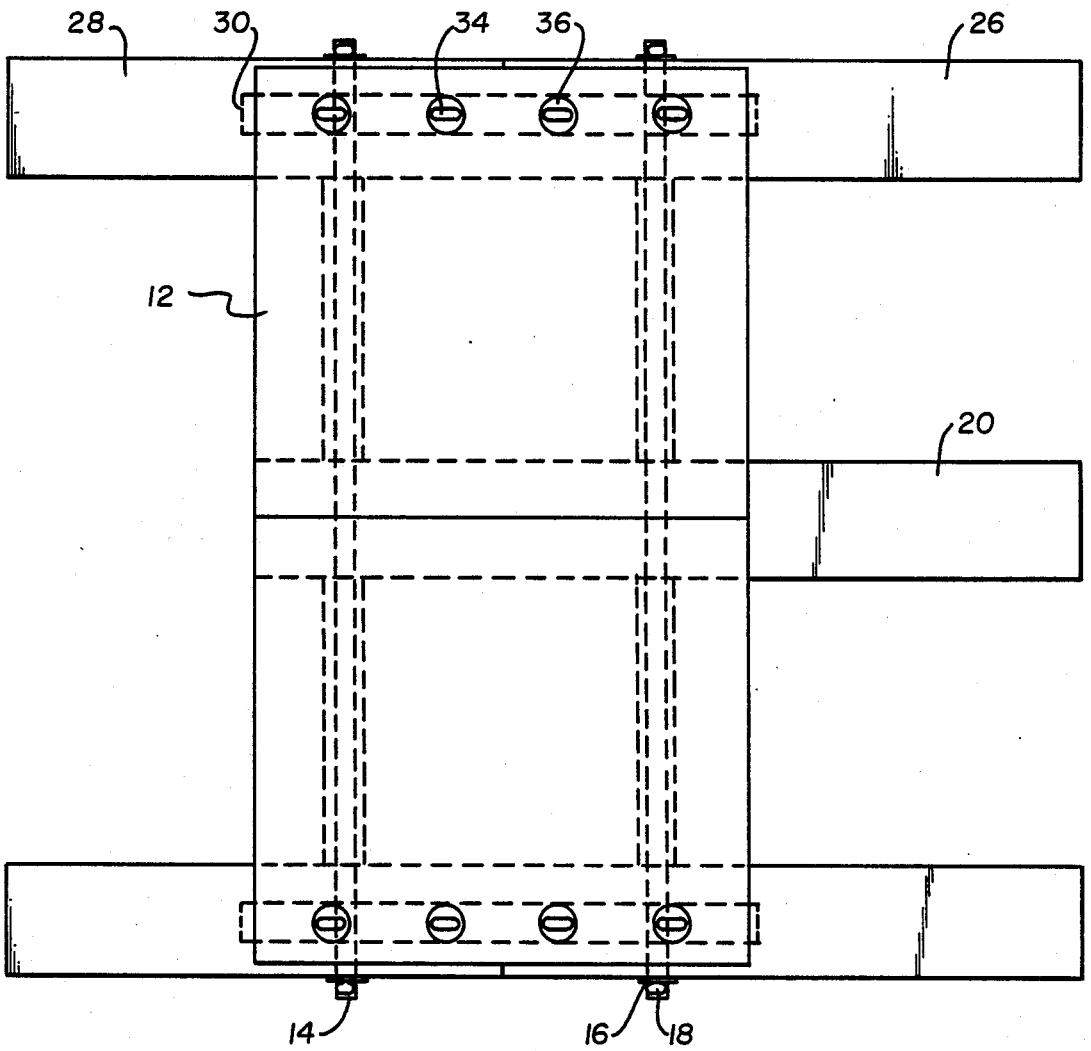
FIG. 9 is a plan view of the two-piece pontoon version with connecting rods.

FIG. 5 shows the exploded view of the two-piece pontoon with forward section 26 and aft section 28. Longitudinal holes 29 are positioned in the abutting surfaces of the pontoon sections approximately midway between top and bottom surfaces to accept a connecting pipe 30 joining the two sections. The said connecting pipe 30 may be cemented in either the forward section 26 or aft section 28 of the pontoon. The connecting pipe 30, having at least two holes 31 positioned in a straight line along the length of the said pipe, so that, when a connecting pipe 39 is inserted in hole 29, hole 31 will mate with at least one vertical hole 33 in each section of the pontoon. Sleeves 32 are inserted through hole 33 so as to mate with hole 31 and may be cemented in the same end in which the connecting pipe 30 is cemented. The two-piece pontoons shown in FIGS. 3, 4, and 5 may be connected by connecting rods 14 as shown in FIGS. 1 and 2. Such embodiment is shown in FIGS. 8 and 9.

Figure 6:
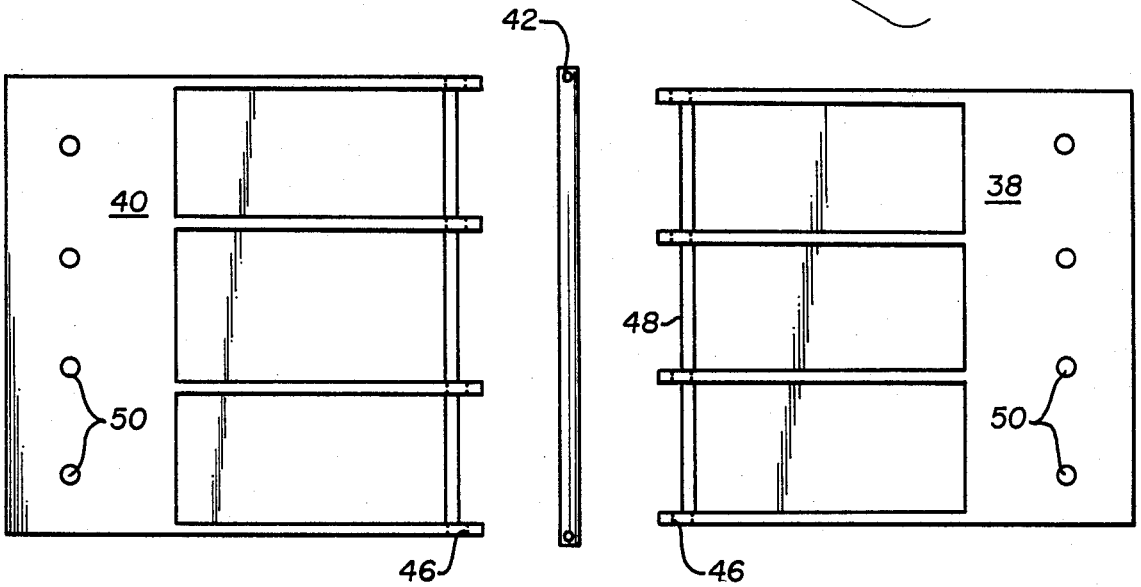
FIG. 6 is a plan view of a folding seat.
Figure 7:
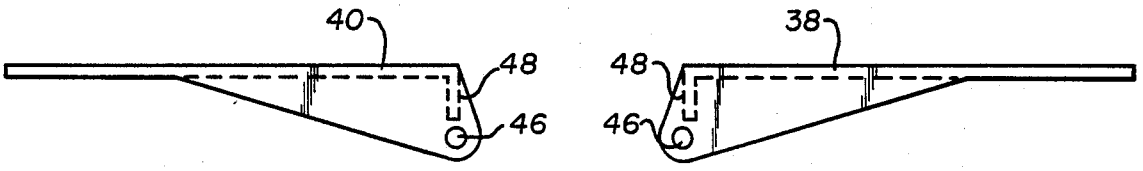
FIG. 7 is a side view of a folding seat.

FIG. 6 is the plan view of the two-piece seat constructed of molded plastic or other material and consisting of a right side 38 a left side 40 and a hinge pin 42. Each side of the seat is reinforced by ribs 44 on the underside which taper to their maximum depth where the two sides are joined by a hinge pin 42 which passes through holes 46 in each rib which will align when both sides of the seat are properly mated. When sides are fully extended the lip 48 on each side will abut the other thereby maintaining the rigidity of the extended seat. At least two holes 50 per side will accept the securing pins 34 described in the description under FIG. 3. FIG. 7 shows a side view of the two-piece seat.

Having thus described an illustrative embodiment of the present invention, it is understood that other embodiments will occur to those skilled in the art and that such modifications or deviations from the illustrated embodiment are considered to be within the purview of the present invention.

We claim:

1. A collapsible one-man pontoon fishing raft comprising:

at least two, spaced, flotational pontoons, said pontoons being of solid construction, means for maintaining the spaced relation between pontoons comprising a one-piece seat having at least two holes near each end which, when said seat is placed on the top surface of said pontoons, will mate with corresponding holes and sleeves in the top surface of the pontoons, securing pins adapted to pass through the holes in the seat and into the holes in the pontoons, said securing pins being of such dimension that they will frictionally engage the sleeves in the holes in the top surface of the pontoons and such that the top of said pin will not pass through the holes in the seat.

2. A collapsible one-man pontoon fishing raft comprising:

at least two, spaced, flotational pontoons, said pontoons being of solid construction, means for maintaining the spaced relation between pontoons comprising a two-piece, hinged, folding seat having at least two holes near each end which, when placed on the top surface of said pontoons, will mate with corresponding holes and sleeves in the top surface of the pontoons, securing pins adapted to pass through the holes in the seat and into the holes in the pontoons, said securing pins being of such dimension that they will frictionally engage the sleeves in the holes in the top surface of the pontoons and such that the top of said pin will not pass through the holes in the seat.

3. The raft defined in claim 1 wherein the pontoons are of two-piece construction comprising a forward section and an aft section of approximate equal length in which there is at least one longitudinal hole in the abutting surface of each pontoon section, which sections, when assembled, have at least one connecting pipe inserted into the longitudinal holes in the abutting surface of each section to join said sections together, perpendicular holes in the top surface of aid sections and holes in said connecting pipe, said connecting pipe being cemented in one of the said sections and secured in the other of the said section by sleeves inserted into said perpendicular holes in the other of said sections, which perpendicular holes correspond with said holes in the connecting pipe so the sleeves, when inserted into the holes in each section, will engage the corresponding holes in the connecting pipe.

4. The raft defined in claim 2 wherein the pontoons are of two-peice construction comprising a forward section and an aft section of approximate equal length in which there is at least one longitudinal hole in the abutting surface of each pontoons section, which sections, when assembled, have at least one connecting pipe inserted into the longitudinal holes in the abutting surface of each section to join said sections together, perpendicular holes in the top surface of said sections and holes in said connecting pipe, said connecting pipe being cemented in one of the said sections and secured in the other of the said section by sleeves inserted into said perpendicular holes in the other of said sections, which perpendicular holes correspond with said holes in the connecting pipe so the sleeves, when inserted into the holes in each section, will engage the corresponding holes in the connecting pipe.

5. A collapsible one-man pontoon fishing raft comprising:

at least two spaced floatational pontoons, with each pontoon being of two-piece construction consisting of a forward section and an aft section of approximate equal length in which there is at least one longitudinal hole in the abutting surface of each pontoon section, which sections, when assembled, have at least one connecting pipe inserted into the longitudinal holes in the abutting surface of each section to join said sections together, perpendicular holes in the top surface of said sections and holes in said connecting pipe, said connecting pipe being cemented in one of the said sections and secured in the other of the said section by sleeves inserted into said perpendicular holes in the other of said sections, which perpendicular holes correspond with said holes in the connecting pipe so the sleeves, when inserted into the holes in each section, will engage the corresponding holes in the connecting pipe, and means for maintaining said pontoons in a spaced relation, said means consisting of:

connecting rods passing perpendicularly through the sides of said pontoons, spacer sleeves over said rods and abutting the inside surfaces of said pontoons, and fastening means on the ends of said rods and outward of said pontoons to prevent their withdrawal from said pontoons, said raft including a seat positioned over connecting rods and rests on the top surface of said pontoons.

6. A collapsible one-man pontoon fishing raft comprising:

at least two spaced floatational pontoons, with each pontoon being of two-piece construction consisting of a forward section and an aft section of approximate equal length in which there is at least one longitudinal hole in the abutting surface of each pontoon section, which sections, when assembled, have at least one connecting pipe inserted into the longitudinal holes in the abutting surface of each section to join said sections together, perpendicular holes in the top surface of said sections and holes in said connecting pipe, said connecting pipe being cemented in one of the said sections and secured in the other of the said section by sleeves inserted into said perpendicular holes in the other of said sections, which perpendicular holes correspond with said holes in the connecting pipe so the sleeves, when inserted into the holes in each section, will engage the corresponding holes in the connecting pipe, means for maintaining said pontoons in a spaced relation, said means consisting of:

a seat having at least two holes near each end which, when said seat is placed on the top surface of said pontoons, will mate with corresponding holes and sleeves in the top surface of the pontoons, securing pins adapted to pass through the holes in the seat and into the holes in the pontoons, said securing pins being of such dimension that they will frictionally engage the sleeves in the holes in the top surface of the pontoons and such that the top of said pin will not pass through the holes in the seat.

* * * * *